US011499791B2

(12) United States Patent
Keeney et al.

(10) Patent No.: US 11,499,791 B2
(45) Date of Patent: Nov. 15, 2022

(54) TRIGGER AND SAFETY ACTUATING DEVICE AND METHOD THEREFOR

(71) Applicant: AimLock Inc., Littleton, CO (US)

(72) Inventors: Raymond Keeney, Littleton, CO (US); Benjamin Dwyer, Littleton, CO (US); Bryan Sterling Bockmon, Littleton, CO (US)

(73) Assignee: AIMLOCK INC., Littleton, CO (US)

( * ) Notice: Subject to any disclaimer, the term of this patent is extended or adjusted under 35 U.S.C. 154(b) by 8 days.

(21) Appl. No.: 17/002,234

(22) Filed: Aug. 25, 2020

(65) Prior Publication Data

US 2021/0131758 A1 May 6, 2021

Related U.S. Application Data

(60) Provisional application No. 62/926,348, filed on Oct. 25, 2019.

(51) Int. Cl.

| | |
|---|---|
| ***F41A 19/59*** | (2006.01) |
| ***F41A 17/46*** | (2006.01) |
| ***F41A 17/06*** | (2006.01) |

(52) U.S. Cl.

CPC ..... *F41A 19/59* (2013.01); *F41A 17/063* (2013.01); *F41A 17/46* (2013.01)

(58) Field of Classification Search

CPC ..... F41A 19/59; F41A 19/58; F41A 19/08; F41A 19/09; F41A 17/063; F41A 17/46

See application file for complete search history.

(56) References Cited

U.S. PATENT DOCUMENTS

| | | | | |
|---|---|---|---|---|
| 3,618,456 | A | 11/1971 | Mindel | |
| 4,012,860 | A * | 3/1977 | Auger | F41A 23/16 73/167 |
| 5,834,677 | A | 11/1998 | Muller | |
| 5,954,507 | A | 9/1999 | Rod et al. | |
| 5,974,940 | A | 11/1999 | Madni | |
| 6,269,730 | B1 | 8/2001 | Hawkes | |
| 6,336,283 | B1 | 1/2002 | Ortiz | |
| 6,885,332 | B2 | 4/2005 | Panek et al. | |
| 7,047,863 | B2 | 5/2006 | Hawkes et al. | |
| 7,210,392 | B2 | 5/2007 | Greene | |
| 7,469,623 | B1 | 12/2008 | Olcott | |
| 8,036,704 | B2 | 10/2011 | Werner | |

(Continued)

FOREIGN PATENT DOCUMENTS

| | | |
|---|---|---|
| CN | 204440222 U | 7/2015 |
| CN | 204514177 U | 7/2015 |

(Continued)

*Primary Examiner* — Joshua E Freeman

(74) *Attorney, Agent, or Firm* — Kilpatrick Townsend & Stockton LLP

(57) ABSTRACT

A trigger device that is attachable to a firearm includes a device body, a trigger mechanism, and a safety mechanism. The trigger device is configured to enable remote firing of the firearm. The device body that is attachable to the firearm to removably couple the trigger device to the firearm. The trigger mechanism is coupled with the device body and is configured to engage a trigger of the firearm to effect firing of the firearm. The safety mechanism is also coupled with the device body and is configured to engage a safety of the firearm to adjust the firearm between a firing mode and a safe mode.

19 Claims, 6 Drawing Sheets

(56) References Cited

U.S. PATENT DOCUMENTS

| | | | | |
|---|---|---|---|---|
| 8,109,191 | B1 | 2/2012 | Rudakevych et al. | |
| 8,336,442 | B2 | 12/2012 | Testa et al. | |
| 8,448,561 | B2 | 5/2013 | Carroll et al. | |
| 8,601,736 | B2 | 12/2013 | Andersson | |
| 8,857,312 | B2 * | 10/2014 | Nelson | B64D 7/06 89/43.01 |
| 9,033,232 | B2 | 5/2015 | Bookman | |
| 9,062,927 | B1 | 6/2015 | Tepaske | |
| 9,151,573 | B2 | 10/2015 | Isola et al. | |
| 9,435,603 | B2 | 9/2016 | Choi | |
| 9,464,856 | B2 | 10/2016 | Lung et al. | |
| 9,612,088 | B2 | 4/2017 | Theriault | |
| 9,784,529 | B1 | 10/2017 | Angle | |
| 9,863,731 | B1 * | 1/2018 | Aiderman | F41A 19/58 |
| D901,615 | S | 11/2020 | Keeney et al. | |
| 10,941,997 | B2 * | 3/2021 | Trimble | F41A 27/22 |
| 2007/0204745 | A1 * | 9/2007 | Son | F41A 19/00 89/37.03 |
| 2008/0121097 | A1 * | 5/2008 | Rudakevych | F41H 7/005 901/1 |
| 2008/0148931 | A1 | 6/2008 | Svensson et al. | |
| 2010/0083817 | A1 | 4/2010 | Son et al. | |
| 2010/0263524 | A1 * | 10/2010 | Morin | F42D 5/04 901/1 |
| 2011/0031312 | A1 | 2/2011 | Laupstad et al. | |
| 2011/0296978 | A1 | 12/2011 | Hamish et al. | |
| 2012/0174741 | A1 | 7/2012 | Rogers | |
| 2014/0028856 | A1 | 1/2014 | Ehrlich | |
| 2014/0360072 | A1 | 12/2014 | Lupher | |
| 2015/0101229 | A1 | 4/2015 | Hall | |
| 2015/0211828 | A1 | 7/2015 | Lupher | |
| 2015/0345887 | A1 | 12/2015 | Shneorson | |
| 2016/0025438 | A1 | 1/2016 | Alderman | |
| 2016/0047617 | A1 * | 2/2016 | DeGidio | F41A 19/08 42/69.01 |
| 2016/0086346 | A1 | 3/2016 | Levilly | |
| 2016/0187094 | A1 | 6/2016 | Bockmon | |
| 2016/0258704 | A1 | 9/2016 | Hobson | |
| 2018/0347930 | A1 | 12/2018 | Bair | |
| 2019/0137219 | A1 | 5/2019 | Bockmon et al. | |
| 2019/0145738 | A1 | 5/2019 | Chae | |
| 2019/0310042 | A1 | 10/2019 | Himmich | |

FOREIGN PATENT DOCUMENTS

| | | | |
|---|---|---|---|
| DE | 102008025499 | A1 | 4/2009 |
| DE | 102015120205 | A1 | 3/2017 |
| ES | 1158783 | U | 6/2016 |
| WO | 2013/183047 | A1 | 12/2013 |

* cited by examiner

TRIGGER AND SAFETY ACTUATING DEVICE AND METHOD THEREFOR

CROSS-REFERENCE TO RELATED APPLICATIONS

This application claims priority to Provisional U.S. Patent Application No. 62/926,348 filed Oct. 25, 2019, entitled "Trigger and Safety Actuating Device and Method Therefor," the entire disclosure of which is hereby incorporated by reference, for all purposes, as if fully set forth herein.

STATEMENT REGARDING FEDERALLY SPONSORED RESEARCH OR DEVELOPMENT

This invention was made with Government support under Contract No. W15QKN-14-9-1001, awarded by U.S. Department of Defense. The Government has certain rights in this invention.

BACKGROUND OF THE INVENTION

The embodiments herein relate generally to trigger devices and more specifically to trigger devices that may be removably attached to a firearm and that are remotely operable to effect firing of the firearm or adjustment of a fire select mode of the firearm.

Firearms are commonly used weapons in lethal and non-lethal situations. Lethal weapons are commonly used in combat to attack or neutralize enemy forces. Non-lethal weapons are commonly used to mitigate or control hostile or combative situations. In either instance, an operator of the weapon may confront dangerous and even life threatening situations. To minimize potential harm to an operator of the weapon, remotely operable weapons and firearms may be used. Such weapons and firearms may enable an operator to assess a situation and respond accordingly without placing the operator in overt danger.

SUMMARY

The embodiments described herein relate generally to devices or mechanisms that are designed to be retrofit to a weapon and that are designed to actuate a trigger or firing mechanism of the weapon. According to a first aspect, a trigger device that is configured for attachment to a firearm includes a device body, a trigger mechanism, and a safety mechanism. The device body is removably attachable to a receiver of the firearm. The device body houses one or more components of the trigger device and is configured so that when attached to the firearm, the device body is positioned about a trigger guard of the firearm. The trigger mechanism is coupled with the device body and is operable to effect firing of the firearm based on a first input received at the trigger device. The trigger mechanism includes a trigger actuating component that is positioned within the trigger guard of the firearm adjacent to an external trigger of the firearm when the device body is attached to the firearm. The trigger actuating component is configured to engage the trigger of the firearm and effect firing of the firearm based on the first input received at the trigger device. The safety mechanism is coupled with the device body and is operable to adjust the firearm between a firing mode and a safe mode based on a second input received at the trigger device. The safety mechanism includes a safety selector component that is configured to engage a safety of the firearm when the device body is attached to the firearm. The safety mechanism is configured to adjust the firearm between the firing mode and the safe mode based on the second input received at the trigger device.

The safety mechanism may include or consist of a belt drive mechanism. In such embodiments, the safety mechanism may include a tension adjustment mechanism that is configured to adjust a tension of a belt of the belt drive mechanism. The trigger actuating component may be a cam. The cam may be rotatably coupled with the device body and may be configured to rotate into engagement with the trigger of the firearm. When coupled with the firearm, the cam may be rotationally offset from the trigger of the firearm so that upon receiving the first input at the trigger device, the cam rotates an initial amount before contacting and engaging the trigger. The trigger device may one or more communication components that allow the trigger device to receive input from one or more external systems. The one or more communication components may include one or more cables or a wireless communication interface.

According to another aspect, a device that is attachable to a firearm and that is configured to enable remote firing of the firearm includes a device body that is attachable to the firearm, a trigger mechanism that is coupled with the device body, and a safety mechanism that is coupled with the device body. The trigger mechanism is configured to engage a trigger of the firearm and effect firing of the firearm and the safety mechanism is configured to engage a safety of the firearm and adjust the firearm between a firing mode and a safe mode.

When the device body is coupled with the firearm, a trigger actuating component of the trigger mechanism may be offset from the trigger so that the trigger actuating component does not contact the trigger until the trigger actuating component is actuated based on input received at the device. The trigger actuating component may be a cam. In such embodiments, the cam may be rotatably coupled with the device body and may be configured to rotate into engagement with the trigger of the firearm.

The safety mechanism may include or consist of a belt drive mechanism. In such embodiments, the safety mechanism includes a tension adjustment mechanism that is configured to adjust a tension of a belt of the belt drive mechanism. The device may also include one or more communication components that allow the device to receive input from one or more external systems. The one or more communication components may include one or more cables or a wireless communication interface.

According to another aspect, a method of attaching a trigger device to a firearm includes providing a trigger device and attaching the trigger device to the firearm. The trigger device may include or consist of a device body, a trigger mechanism that is configured to engage a trigger of the firearm and effect firing of the firearm, and a safety mechanism that is configured to engage a safety of the firearm and adjust the firearm between a firing mode and a safe mode. The trigger device may be configured to attach to a pistol grip receptacle of the firearm. Attaching the trigger device to the firearm may include fastening a single bolt or fastener. Attaching the trigger device to the firearm may include positioning a trigger actuating component of the trigger mechanism within a trigger guard of the firearm adjacent to the trigger of the firearm.

Attaching the trigger device to the firearm may include coupling a safety selector component of the safety mechanism with the safety of the firearm. The safety selector component may be coupled with an upper pulley. In such embodiments, the method may also include coupling the upper pulley to a lower pulley via a belt. The method may further include adjusting a tension of the belt.

According to another aspect, a method of remotely operating a firearm includes providing a firearm having a trigger device coupled therewith, receiving an input from a remotely located device, and actuating the trigger actuating component to cause the trigger actuating component to engage the trigger of the firearm and thereby effect firing of the firearm. The trigger device may include a device body that is coupled with the firearm, a trigger mechanism having a trigger actuating component that is positioned adjacent to a trigger of the firearm, and a safety mechanism that is operably coupled with a safety of the firearm. The trigger device may also include one or more communication components and one or more processors. The input from the remotely located device may be received via the one or more communication components. The trigger actuating component may be actuated via the one or more processors to cause the trigger actuating component to engage the trigger of the firearm and thereby effect firing of the firearm.

In some embodiments, the input may be a first input. In such embodiments, the method may also include receiving, via the one or more communication components, a second input from the remotely located device and actuating, via the one or more processors, the safety mechanism to engage the safety of the firearm and thereby adjust the firearm between a firing mode and a safe mode.

BRIEF DESCRIPTION OF THE DRAWINGS

The present technology is described in conjunction with the appended figures.

Figure 1:
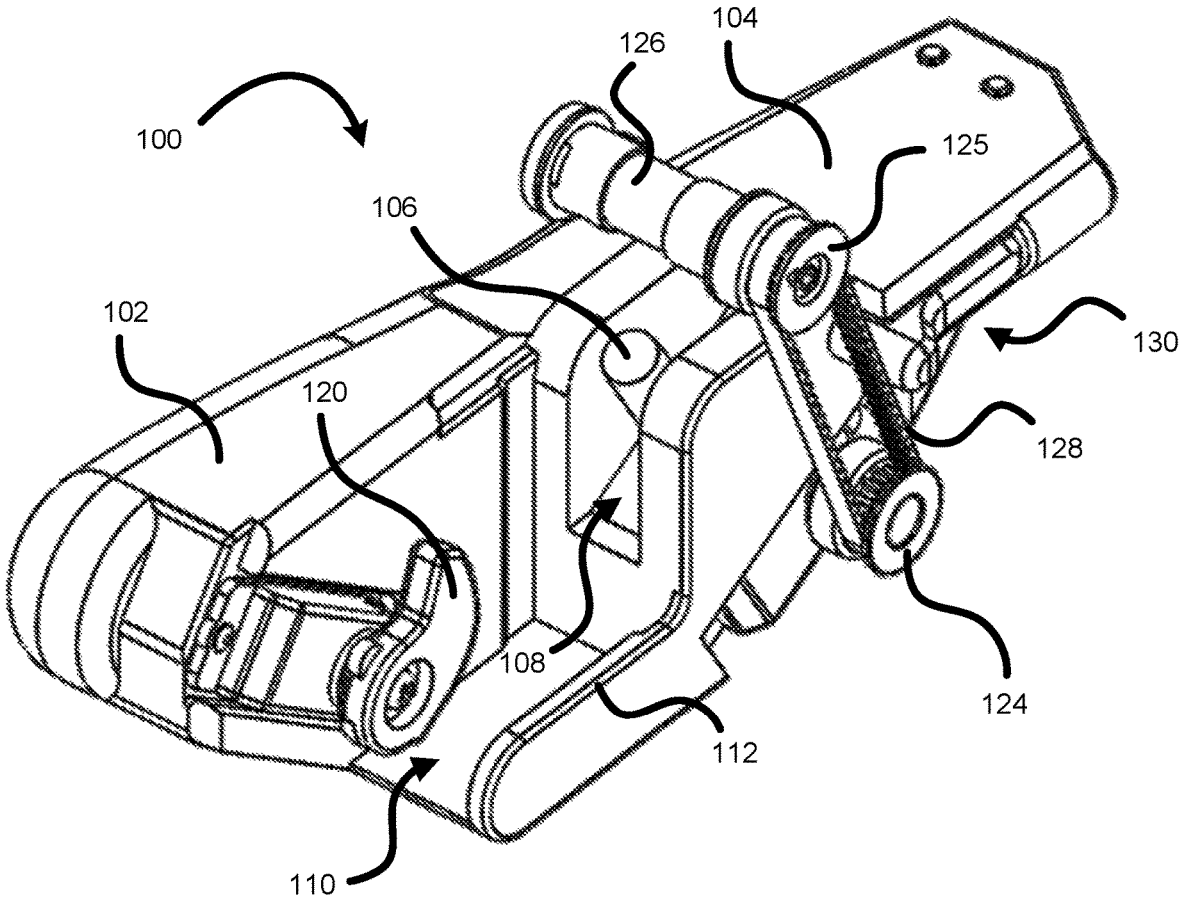
FIG. 1 illustrates a perspective view of a trigger and safety mechanism that may be fit to a firearm to enable remote control of the firearm.
Figure 2:
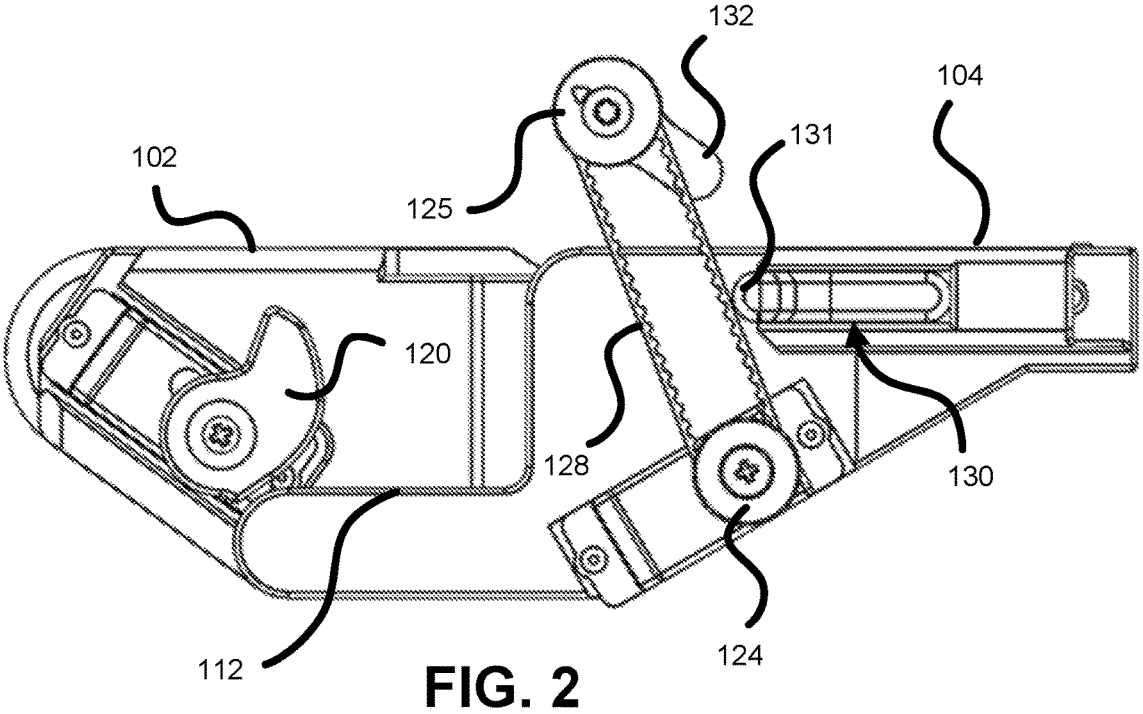
FIG. 2 illustrates a first side view of the trigger and safety mechanism of FIG. 1.
Figure 3:
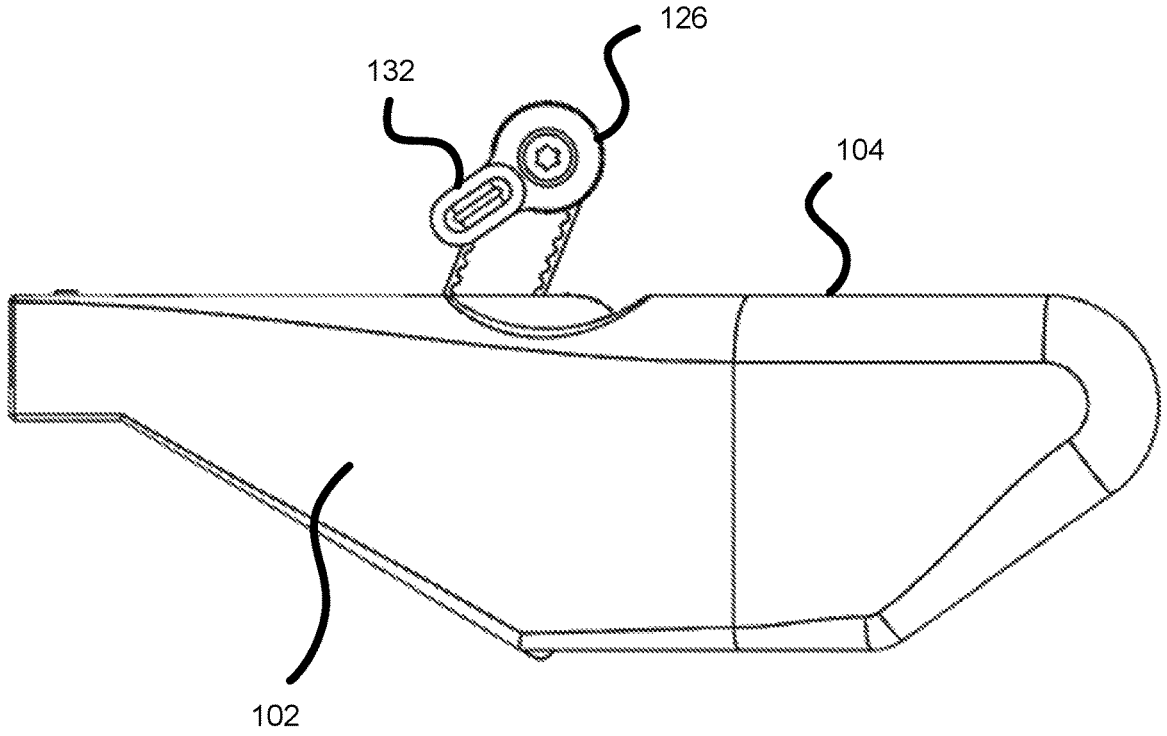
FIG. 3 illustrates a second side view of the trigger and safety mechanism of FIG. 1.
Figure 4:
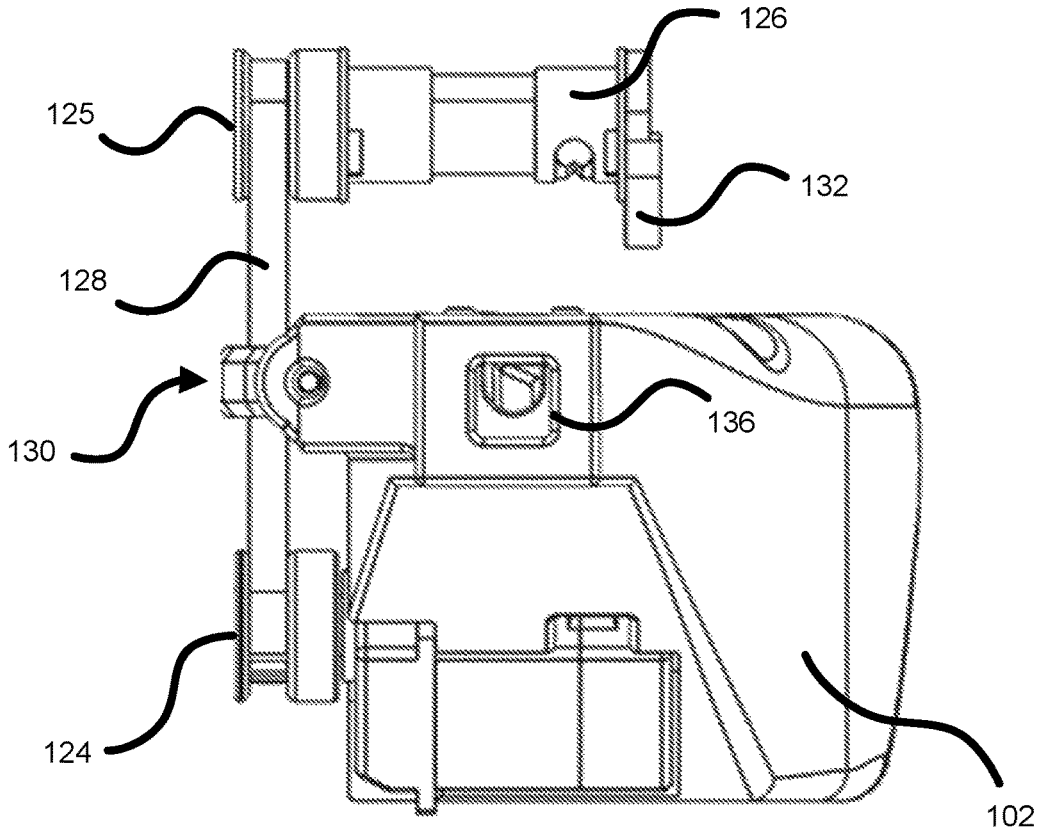
FIG. 4 illustrates a rear view of the trigger and safety mechanism of FIG. 1.
Figure 5:
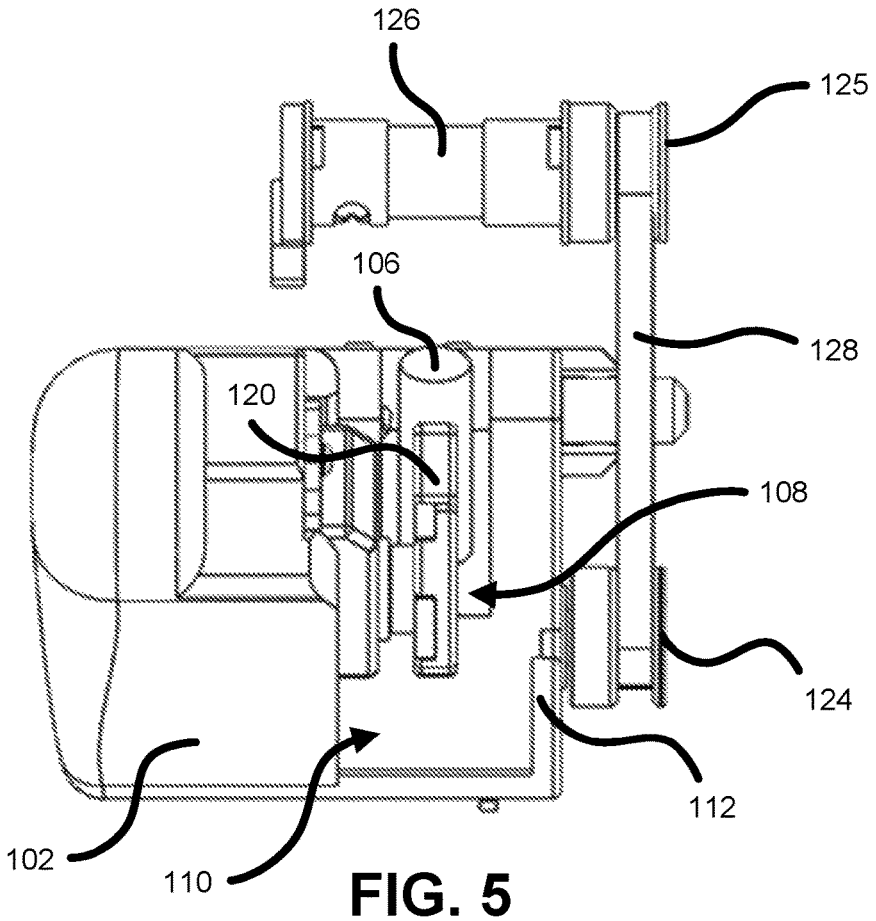
FIG. 5 illustrates a front view of the trigger and safety mechanism of FIG. 1.
Figure 6:
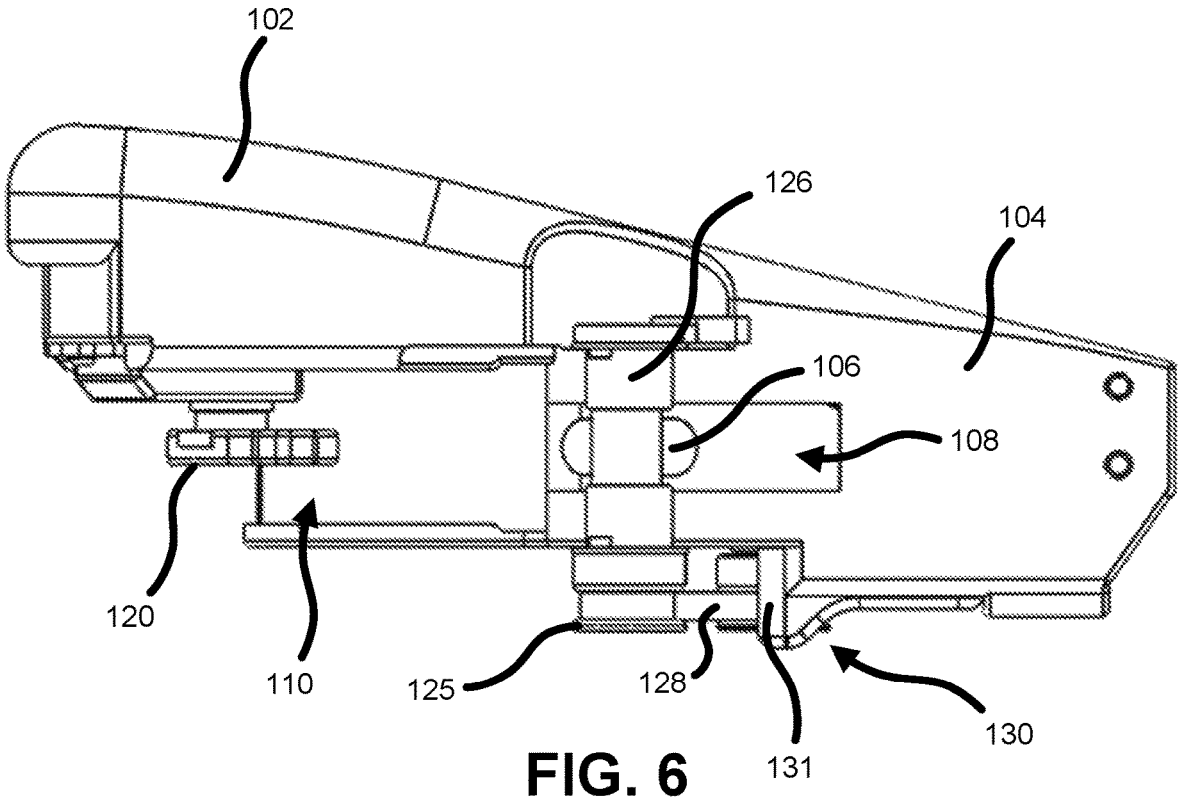
FIG. 6 illustrates a top view of the trigger and safety mechanism of FIG. 1.
Figure 7:
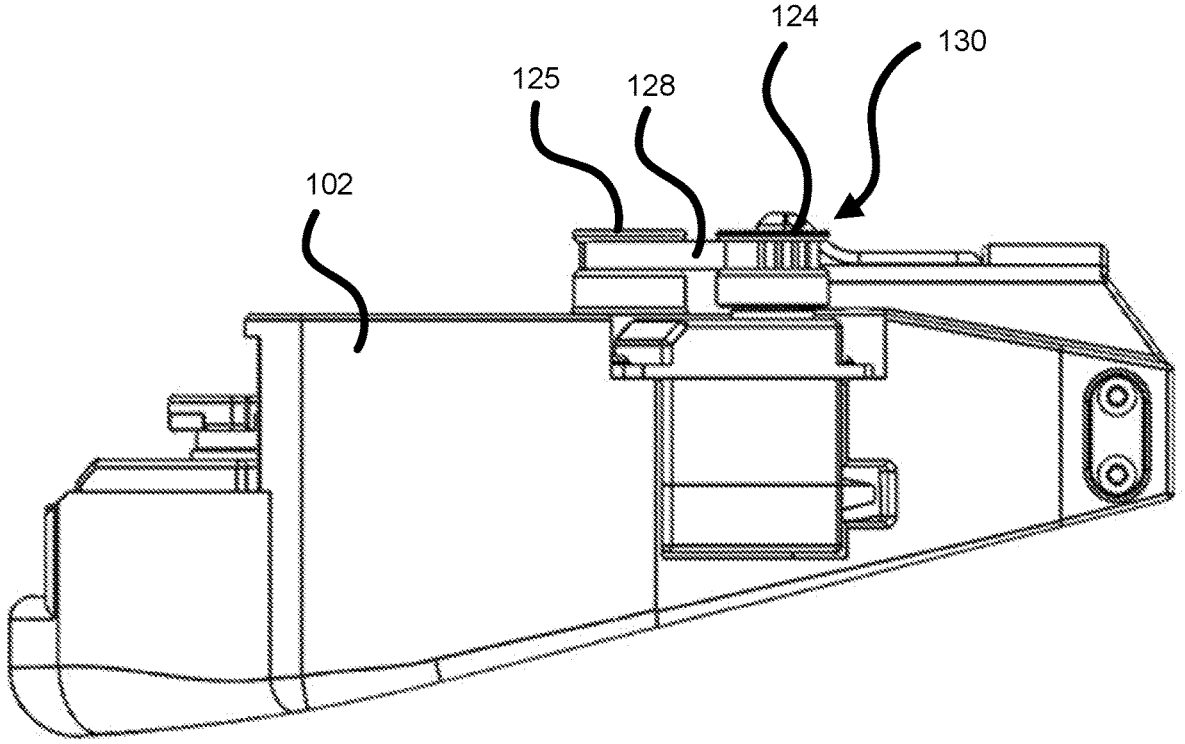
FIG. 7 illustrates a bottom view of the trigger and safety mechanism of FIG. 1.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It being understood that various changes may be made in the function and arrangement of elements without departing from the spirit and scope of the invention as set forth in the appended claims.

The embodiments described herein relate to devices or mechanisms that are designed to be retrofit to a weapon, and more specifically a firearm, and that are designed to actuate a trigger or firing mechanism of the weapon (hereinafter firearm). The device is also typically designed so that it is able to actuate a safety mechanism of the firearm to adjust the safety mechanism between a fire capable mode or state (hereinafter firing mode) and a non-fire capable mode or state (hereinafter safe mode). The device is remotely operable by a user to actuate the trigger and/or safety mechanism of the firearm. In some instances, the device may be wirelessly operated or controlled by the user.

The device is typically a small unit that is able to be quickly retrofit to essentially any weapon without inhibiting an inherent reliability of the firearm platform. The device may be particularly useful for AR-10, AR-15, and other firearms of similar type and/or size. The device is configured to attach to the frame or lower receiver of the firearm in a manner that securely fixes the device to the lower receiver. The device is capable of being attached to the lower receiver with a single bolt or fastener. The device may also be easily detached and removed from the lower receiver. The device includes a trigger interface component that engages the trigger mechanism of the firearm and that enables an actuation of the trigger mechanism. The device also includes a safety interface component that engages with the safety mechanism of the firearm and enables the firearm to be toggled or adjusted between the firing mode and the safe mode. In some instances the firearm may have multiple firing modes, such as a semi-automatic firing mode and a fully automatic firing mode. In such instances, the device may be configured to toggle or adjust the firearm between both firing modes so that a desired firing mode may be selected by the user.

Having described several features of the device generally, additional aspects and features will be readily apparent in reference to the description of the various drawings provided herein below.

Referring to FIG. 1, illustrated is perspective view of a trigger and/or safety mechanism 100 that is designed for retrofit attachment to a firearm and that is operable to actuate a trigger and/or safety mechanism of the firearm (hereinafter trigger/safety mechanism 100). FIGS. 2-7 illustrate front, back, top, bottom, and side views of the trigger/safety mechanism 100.

The trigger/safety mechanism 100 has a device body 102 that structurally supports and houses various components of the trigger/safety mechanism 100. The trigger/safety mechanism 100 is an electro-mechanical device that includes internal electrical and mechanical components (not shown) that operate to allow the trigger/safety mechanism 100 to actuate the trigger and/or safety mechanisms of the firearm. For example, the trigger/safety mechanism 100 may include one or more processors (not shown) that are configured to control one or more electrical and/or mechanical components based on input or instructions that are transmitted to the trigger/safety mechanism 100 and/or communicated to the processor(s). The trigger/safety mechanism 100 may also include one or more memory or data storage devices that are communicatively coupled with the processor(s) in order to communicate instructions to the processor(s) to effect control of the one or more electrical and/or mechanical components. The trigger/safety mechanism 100 may additionally include one or more wireless communication components that enable the trigger/safety mechanism 100 to send and receive wireless signals with external computing devices, thereby enabling a user to wirelessly control the trigger/safety mechanism 100.

In some embodiments, one or more of these electrical components (i.e., the processor(s), memory, wireless communication component(s), etc.) may be housed in a device that is separate from the trigger/safety mechanism 100. For example, the trigger/safety mechanism 100 may be used in combination with a weapon mount or station that controls an orientation and aiming of the firearm. An exemplary weapon mount or station is further described in U.S. Provisional Application No. 62/926,339, filed Oct. 25, 2019, entitled "Remotely Operably Weapon Mount", the entire disclosure of which is incorporated by reference herein. In such embodiments, one or more of the above described electrical devices may be housed within the weapon mount or station rather than within the device body 102 of the trigger/safety mechanism 100. In such embodiments, the trigger/safety mechanism 100 may include one or more communication cables that allow the trigger/safety mechanism 100 to communicate with the weapon mount or station, or the trigger/safety mechanism 100 may be configured to wirelessly communicate with the weapon mount or station. In such embodiments, the trigger/safety mechanism 100 may only include electro-mechanical components that operate the trigger and/or safety engagement mechanisms. The trigger/safety mechanism 100 may also be wirelessly coupled with a control device so that a user is able to remain in control of the firearm at all times.

The device body 102 is designed for attachment and securement to a frame of the firearm, and is commonly designed to accommodate typical lower receivers of various firearms, such as an AR-15. The device body 102 is commonly attached to the lower receiver so that the trigger/safety mechanism 100 is positioned immediately behind the trigger guard, although the position of the trigger/safety mechanism 100 may be varied about the firearm as desired or required for a particular application. The body 102 of the trigger/safety mechanism 100 is elongate and includes a recess or channel 110 that is positioned closer to one side of the body 102. The recess 110 is shaped and sized to accommodate the trigger guard of the firearm when the trigger/safety mechanism 100 is attached to the firearm. The recess 110 is bounded on one side by the device body 102 and is bounded on the other side by a lip or flange 112. The lip or flange 112 aids in securing the trigger/safety mechanism 100 in position about the lower receiver by providing a surface that the trigger guard contacts to prevent or limit rotation of the trigger/safety mechanism 100 about the lower receiver. The trigger guard may also abut a rear surface of the recess 110, which further aids in securing the trigger/safety mechanism 100 in position about the lower receiver. The rear surface of the recess 110 may be roughly planar or have any other geometric configuration that matches a configuration of the trigger guard.

A trigger actuating component 120 is positioned within the recess 110 so that when the trigger/safety mechanism 100 is attached to the firearm, the trigger actuating component 120 is able to contact and engage the trigger of the firearm. When the trigger/safety mechanism 100 is attached to the firearm, the trigger actuating component 120 is typically positioned within the trigger guard and adjacent to the trigger. The trigger actuating component 120 may be slightly offset from the firearm's trigger in an initial position or pre-firing position. The slight offset of the trigger actuating component 120 and trigger results in a small gap being present between the trigger actuating component 120 and the trigger. As such, the trigger actuating component 120 may not contact the trigger until the trigger actuating component 120 is actuated to depress the trigger and fire the firearm. The slightly offset position of the trigger actuating component 120 may enable the trigger actuating component to be smaller without negatively affecting the ability of the trigger actuating component 120 to engage the trigger and fire the firearm. The trigger actuating component 120 is actuatable via electro-mechanical components (not shown) that are disposed within the device body 102 behind the trigger actuating component 120. The electro-mechanical components are operably coupled to the processor(s) and are controllable by the processor(s) based on one or more inputs communicated to the trigger/safety mechanism 100, typically from a remotely located device. The electro-mechanical components may include servo motors and/or other components that are able to control the trigger actuating component 120.

In a specific embodiment, the trigger actuating component 120 is a rotatable cam that has a cam profile that engages with the trigger and causes the trigger to effect firing of the firearm upon rotation of the cam within the recess 110. The cam is typically a disc or plate that is able to rotate fully around within the recess 110. The cam is shaped, sized, and configured to enable both semi-automatic and automatic firing of the weapon. For example, the cam may be rotated a single time to effect firing of a single round, or the cam may be rotated to effect a short burst of rounds (e.g., three shots) or an automatic discharge of the firearm. Automatic or short burst firing may be implemented by controlling the rotation of the cam, via software, so that cam rotation is halted or stopped in a firing mode, or the cam may be shaped so that the trigger is depressed during a specified angular rotation of the cam. The cam is servo driven or rotatable to enable engagement of the trigger and discharge of the firearm. The servo can be belt driven, chain driven, ladder driven, geared, direct driven, and the like in order to rotate the cam within the recess 110. The cam may be offset rotationally or angularly from the firearm's trigger so that the cam is required to rotate an initial amount (e.g., between 5 and 25 degrees) before contacting and engaging the firearm's trigger. The slight rotational or angular offset results in a small gap being present between the cam and the trigger. The slight angular or rotational offset of the cam enables the cam to build up angular momentum before contacting and engaging the trigger. The cam may have a profile that is designed to actuate the trigger in as quick a manner as possible in order to minimize latency between an operator providing a firing input and firing of the firearm. In other embodiments, the trigger actuating component 120 may include any type of linear actuator (e.g., solenoid), voice coil actuator, piezo actuator, lead screw, rack-and-pinion, and the like.

The cam profile is configured to match the profile of the firearm's trigger. In some instances, a cam profile may be employed that is universal to most or all firearms. In other instances, a specific cam profile may be employed based on a specific trigger shape and size of the firearm. The trigger/safety mechanism 100 may include one or more sensors (not shown) that are useful in determining a position of the trigger actuating component within the recess 110. For example, the trigger/safety mechanism 100 may include a sensor that detects a duration of fire, a position of the cam, or any other sensors that enables the processor(s) to determine an orientation of the cam within the recess 110.

Because the electro-mechanical components that drive the trigger actuating component 120 are disposed within the body 102, the device body 102 has a non-symmetric shape along its longitudinal length. Specifically, the body 102 extends forward of, and outward of, the recess 110 on one side in order to accommodate and house the electro-mechanical components that drive the trigger actuating component 120. As such, when the trigger/safety mechanism 100 is attached to the firearm, one side of the body 102 extends outward from the firearm to a greater degree that an opposite side of the body 102. The non-symmetrical shape of the trigger/safety mechanism 100 typically results in a majority of the trigger/safety mechanism 100 being positioned on one side of the firearm's trigger pack.

In a specific embodiment, the trigger/safety mechanism 100 may be retrofit to the firearm by attaching the trigger/safety mechanism 100 to the lower receiver in place of a pistol grip. The pistol grip may be removed from the lower receiver and the trigger/safety mechanism 100 may be attached to the lower receiver so that the trigger/safety mechanism 100 occupies roughly the same positon about the lower receiver as the pistol grip. In some embodiments, the device body 102 has a relatively flat and planar surface 104, which corresponds to a lower surface of the lower receiver. The flat surface 104 allows the trigger/safety mechanism 100 to sit relatively flush against the lower surface of the lower receiver.

The device body 102 also includes a channel 108 that is shaped and sized to correspond to a rib or projection of the lower receiver. The channel 108 allows the trigger/safety mechanism 100 to fit securely onto and about the lower receiver. Component 106 represents a standard bolt/fastener that interfaces with the lower receiver of the firearm. The standard bolt/fastener 106 is the primary attachment point or interface between the trigger/safety mechanism 100 and the weapon. The standard bolt/fastener 106 is positioned within the channel 108 and attaches to the lower receive of the firearm to secure the trigger/safety mechanism 100 to the firearm. The configuration of the trigger/safety mechanism 100 allows a single bolt or fastener to be used to attach and fasten the trigger/safety mechanism 100 to the firearm. In some embodiments, the bolt or fastener can attach to a threaded aperture that is commonly used to attach the pistol grip to the firearm.

As described above, the trigger/safety mechanism 100 is typically designed so that it is capable of actuating the safety mechanism of the firearm and thereby adjusting the safety mechanism between the firing mode and the safe mode. In one embodiment, the trigger/safety mechanism 100 employs a pulley system that is operably coupled to the firearm's safety mechanism. The pulley system of the trigger/safety mechanism 100 is designed to work on essentially any safety mechanism of most firearms. The pulley system is a belt drive system that includes a lower pulley 124, an upper pulley 125, and a toothed belt that is positioned around the upper and lower pulley, 125 and 124, and is operably coupled therewith. The lower pulley 124 is coupled with a servo motor (not shown) that is housed within the device body 102. The servo motor drives and rotates the lower pulley 124, which in turn drives the toothed belt and upper pulley 125.

The upper pulley is attached to one end of a safety selector 126, which is operably engaged with the safety mechanism of the firearm. Rotation of the safety selector 126 via the pulley system causes the firearm's safety mechanism to toggle or switch between the firing mode and the safe mode. The pulley system may rotate the safety selector 126 in a first direction (e.g., clockwise) to place the firearm in the firing mode and may rotate the safety selector 126 in a second direction (e.g., counterclockwise) to place the firearm in the safe mode. Component 132 provides a visual indication of the fire-select mode the firearm—i.e., firing mode or safe mode. Component 132 functions with standard fire-select positions that are commonly found on firearms and allows an operator to quickly visually determine the fire-select mode of the firearm. Specifically, component 132 is designed so that when a lever arm is facing towards a rear of the firearm, the firearm is in the safe mode and when the lever arm is facing down, the firearm is in the firing mode. In this manner, component 132 allows an operator to quickly visually assess the status of the weapon. As previously described, the firearm may have multiple firing modes, such as a semiautomatic mode and a fully automatic mode. In such embodiments, the pulley system may be configured to switch the firearm between the multiple firing modes.

The trigger/safety mechanism 100 includes a tensioning mechanism 130 for tensioning the belt 128. Tensioning of the belt 128 allows the trigger/safety mechanism 100 to accommodate different sized firearms. The tensioning mechanism 130 includes a screw or other threaded component that may be rotated to increase or decrease an engagement of a distal end 131 of the tensioning mechanism 130 with the belt 128. The tensioning mechanism 130 ensures that the belt has a proper amount of tension so that an operation of the pulley system causes the safety selector 126 to actuate the firearm's safety mechanism. Component 136 is a access port for a power and signal cable (not shown) that is inserted through a channel or bore within the device body 102. The access port 136 provides strain relief for the power and signal cable, which prevents or minimizes issues such as kinking or crimping of the cable and wires.

Figure 8:
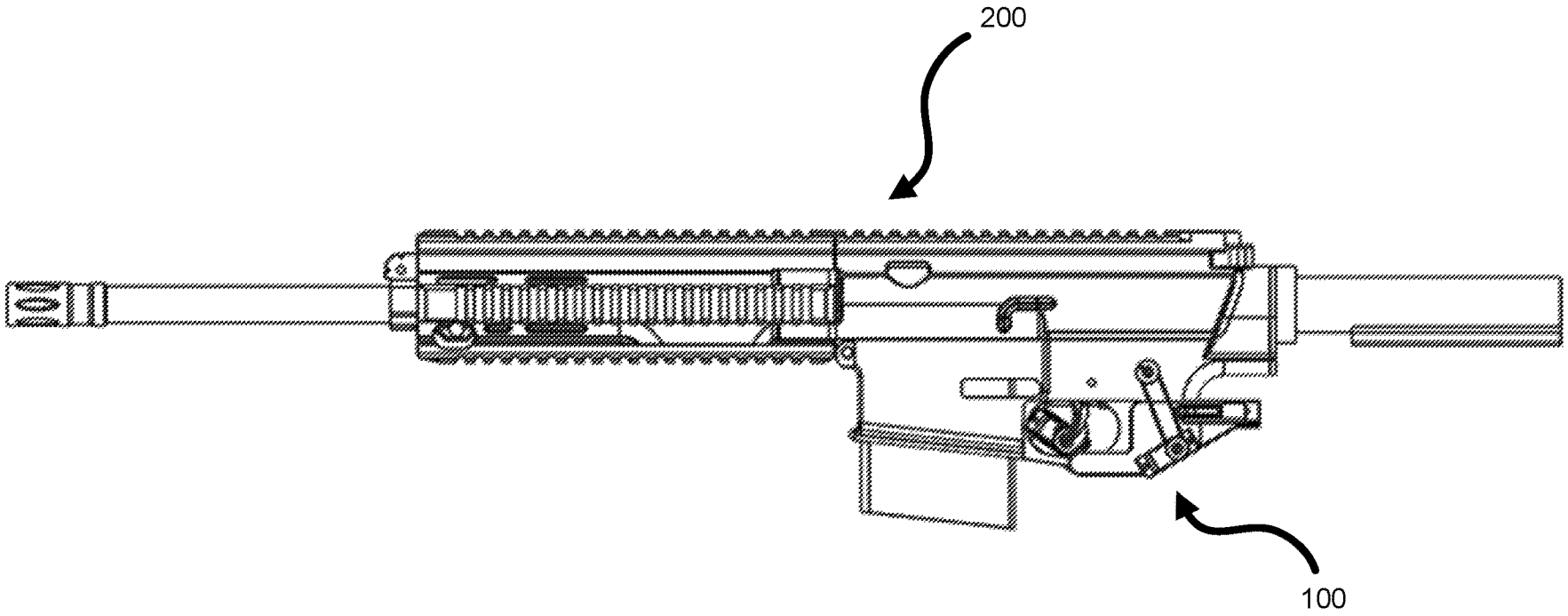
FIG. 8 illustrates the trigger and safety mechanism of FIG. 1 attached to a firearm.

FIG. 8 illustrates the trigger/safety mechanism 100 coupled with a firearm 200. The trigger/safety mechanism 100 is coupled to the firearm 200 in a position that would typically be occupied by a pistol grip. As illustrated, the trigger/safety mechanism 100 sits flush against a lower surface of the receiver and has a relatively small profile. In particular, the trigger/safety mechanism 100 extends slightly outward from a rear surface of the lower receiver and has a height that extends from the lower receiver to slightly below the trigger guard of the firearm 200. The width of the trigger/safety mechanism 100 is roughly equivalent to a width of the firearm 200 or smaller. The trigger/safety mechanism 100 is attached to the firearm 200 so that the pulley system and safety selector 126 are engaged with the firearm's safety mechanism and so that the trigger actuating component 120 is engaged with the trigger as described herein. In an initial position, or pre-firing position, the trigger actuating component 120 is slightly offset from the firearm's trigger. As such, the trigger actuating component 120 does not contact the trigger until the trigger actuating component 120 is actuated based on input received at the trigger/safety mechanism 100. For example, when the trigger actuating component 120 is a cam, the cam may be rotationally offset from the firearm's trigger so that the cam is required to rotate an initial amount (e.g., between 5 and 25 degrees) before contacting and engaging the firearm's trigger. With the trigger/safety mechanism 100 attached to the firearm 200, the trigger/safety mechanism 100 is able to be remotely operated to switch the firearm between the firing mode and the safe mode and to fire the weapon.

In some embodiments, the trigger/safety mechanism 100 may have one or more sensors and/or sensing functions. For example, the trigger/safety mechanism 100 may include one or more gyros, accelerometers, inertial measurement units, and the like. The devices may be employed to sense various conditions, such as an orientation of the mechanism, a shock of the mechanism, an acceleration of the mechanism, and the like. For example, the devices can sense acceleration or shock, such as a recoil of the firearm 200, to determine if a shot was fired from the firearm. This information may be used to ensure that the firearm is successfully discharged when a firing instruction is transmitted to the trigger/safety mechanism 100. In other instances, the one or more sensors can determine or sense a failure of the firearm or of the trigger/safety mechanism 100 itself.

Figure 9:
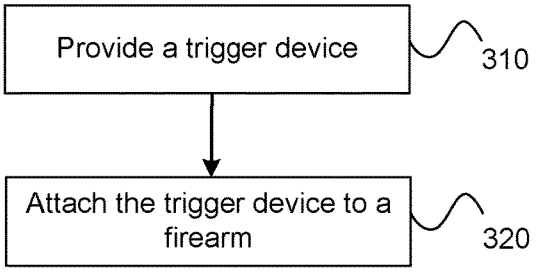
FIG. 9 illustrates a method of attaching a trigger device with a firearm.

Referring now to FIG. 9, illustrated is a method of attaching a trigger device with a firearm. At block 310, a trigger device is provided. The trigger device may include any of the components described herein in any combination. For example, the trigger device may include a device body, a trigger mechanism that is configured to engage a trigger of the firearm and effect firing of the firearm, and a safety mechanism that is configured to engage a safety of the firearm and adjust the firearm between a firing mode and a safe mode. At block 320, the trigger device is attached to the firearm.

In some embodiments, the trigger device is configured to attach to a pistol grip receptacle of the firearm, although the trigger device may be attached to other areas or components of the firearm as desired. Attaching the trigger device to the firearm may include fastening a single bolt or fastener to the pistol grip receptacle of the firearm. Attaching the trigger device to the firearm may also include positioning a trigger actuating component of the trigger mechanism within a trigger guard of the firearm so that the trigger actuating component is adjacent to a trigger of the firearm. Attaching the trigger device to the firearm may also include coupling a safety selector component of the safety mechanism with the safety of the firearm. The safety selector may be coupled with an upper pulley and the method may also include coupling the upper pulley to a lower pulley via a belt. In such embodiments, the method may also include adjusting a tension of the belt.

Figure 10:
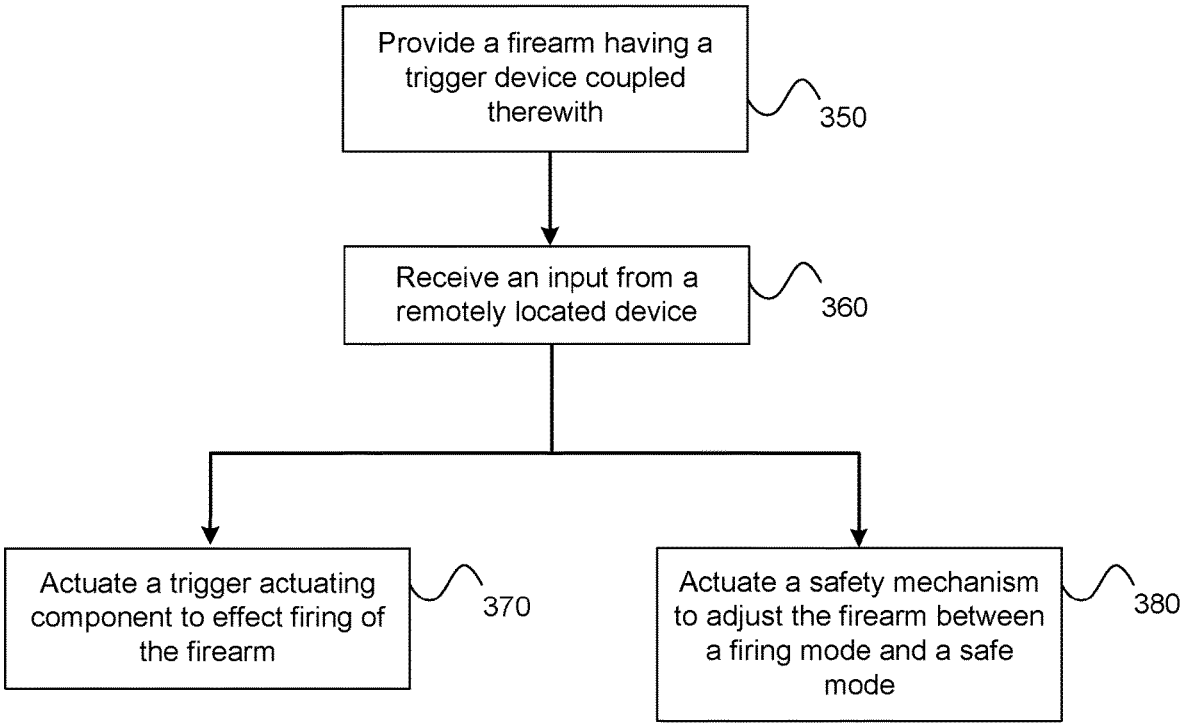
FIG. 10 illustrates a method of remotely operating a firearm.

Referring now to FIG. 10, illustrated is a method of remotely operating a firearm. At block 350, a firearm having a trigger device coupled therewith is provided. The firearm and trigger device may be configured as described herein. For example, the trigger device may include a device body, a trigger mechanism, a safety mechanism, one or more communication components, and one or more processors. The device body may be coupled with the firearm, the trigger mechanism may include a trigger actuating component that is positioned adjacent to a trigger of the firearm, and/or the safety mechanism may be operably coupled with a safety of the firearm. At block 360, an input from a remotely located device is received via the one or more communication components. The remotely located device may be attached to a chassis within which the firearm is position, or may be entirely separate from the chassis and firearm and positioned a substantial distance from the firearm. The chassis may include a trigger that mimics the function and feel or a conventional firearm trigger. The chassis, or remotely located device, may include processor(s) and/or communication component(s) that interface with the trigger device to send and receive input between the chassis/remotely located device and the trigger device. In other embodiments, the remotely located device may include buttons or other components that an operator may actuate to provide the first or second inputs. At block 370, the trigger actuating component is actuated via the one or more processors. Actuation of the trigger actuating component causes the trigger actuating component to engage the trigger of the firearm and thereby effect firing of the firearm.

In some embodiments, the input received at block 360 is a first input that effects actuation of the trigger actuating component. In other embodiments, the input received at block 360 may represent a second input that is received from the remotely located device via the one or more communication components. In such embodiments, the safety mechanism may be actuated at block 380 via the one or more processors. Actuating the safety mechanism causes the safety mechanism to engage the safety of the firearm and thereby adjust the firearm between a firing mode and a safe mode. It should be noted that block 370 or block 380 may optionally be performed based on the input received at block 360. It should also be noted that the input received at block 360 may represent both the first input and the second input, in which case the steps illustrated at blocks 370 and 380 may be performed in any order. In such instances, separate inputs would be received at block 360 for the first input and the second input.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention. It is to be understood that any workable combination of the features and elements disclosed herein is also considered to be disclosed. Additionally, any time a feature is not discussed with regard in an embodiment in this disclosure, a person of skill in the art is hereby put on notice that some embodiments of the invention may implicitly and specifically exclude such features, thereby providing support for negative claim limitations.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included.

As used herein and in the appended claims, the singular forms "a", "an", and "the" include plural referents unless the context clearly dictates otherwise. Thus, for example, reference to "a process" includes a plurality of such processes and reference to "the device" includes reference to one or more devices and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A trigger device that is configured for attachment to a firearm, the trigger device comprising:

a device body that is removably attachable to a receiver of the firearm, the device body housing one or more components of the trigger device and the device body being configured so that when attached to the firearm, the device body is positioned about a trigger guard of the firearm;

a trigger mechanism that is coupled with the device body and that is operable to effect firing of the firearm based on a first input received at the trigger device, the trigger mechanism including a trigger actuating component that is positioned within the trigger guard of the firearm adjacent to an external trigger of the firearm when the device body is attached to the firearm, the trigger actuating component being configured to engage the trigger of the firearm and effect firing of the firearm based on the first input received at the trigger device; and a safety mechanism that is coupled with the device body and that is operable to adjust the firearm between a firing mode and a safe mode based on a second input received at the trigger device, the safety mechanism including a safety selector component that is configured to engage a safety of the firearm when the device body is attached to the firearm and adjust the firearm between the firing mode and the safe mode based on the second input received at the trigger device;

wherein the safety mechanism comprises a belt drive mechanism.

2. The trigger device of claim 1, wherein the safety mechanism comprises a tension adjustment mechanism that is configured to adjust a tension of a belt of the belt drive mechanism.

3. The trigger device of claim 1, wherein the trigger actuating component is a cam.

4. The trigger device of claim 3, wherein the cam is rotatably coupled with the device body and is configured to rotate into engagement with the trigger of the firearm.

5. The trigger device of claim 4, wherein when coupled with the firearm, the cam is rotationally offset from the trigger of the firearm so that upon receiving the first input at the trigger device, the cam rotates an initial amount before contacting and engaging the trigger.

6. The trigger device of claim 1, wherein the trigger device include one or more communication components that allow the trigger device to receive input from one or more external systems.

7. The trigger device of claim 6, wherein the one or more communication components include one or more cables or a wireless communication interface.

8. A device that is attachable to a firearm and that is configured to enable remote firing of the firearm, the device comprising:

a device body that is attachable to the firearm;

a trigger mechanism coupled with the device body, the trigger mechanism being configured to engage a trigger of the firearm and effect firing of the firearm; and a safety mechanism coupled with the device body, the safety mechanism being configured to engage a safety of the firearm and adjust the firearm between a firing mode and a safe mode;

wherein the safety mechanism comprises a belt drive mechanism.

9. The device of claim 8, wherein when the device body is coupled with the firearm, a trigger actuating component of the trigger mechanism is offset from the trigger so that the trigger actuating component does not contact the trigger until the trigger actuating component is actuated based on input received at the device.

10. The device of claim 9, wherein the trigger actuating component is a cam.

11. The device of claim 10, wherein the cam is rotatably coupled with the device body and is configured to rotate into engagement with the trigger of the firearm.

12. The device of claim 8, wherein the safety mechanism comprises a tension adjustment mechanism that is configured to adjust a tension of a belt of the belt drive mechanism.

13. The device of claim 8, wherein the device further comprises one or more communication components that allow the device to receive input from one or more external systems.

14. The device of claim 13, wherein the one or more communication components include one or more cables or a wireless communication interface.

15. A method of attaching a trigger device to a firearm, the method comprising:

providing a trigger device comprising:

a device body;

a trigger mechanism that is configured to engage a trigger of the firearm and effect firing of the firearm; and a safety mechanism that is configured to engage a safety of the firearm and adjust the firearm between a firing mode and a safe mode;

attaching the trigger device to the firearm, including coupling a safety selector component of the safety mechanism with the safety of the firearm, wherein the safety selector component is coupled with an upper pulley; and coupling the upper pulley to a lower pulley via a belt.

16. The method of claim 15, wherein the trigger device is configured to attach to a pistol grip receptacle of the firearm.

17. The method of claim 15, wherein attaching the trigger device to the firearm comprising fastening a single bolt or fastener.

18. The method of claim 15, wherein attaching the trigger device to the firearm comprises positioning a trigger actuating component of the trigger mechanism within a trigger guard of the firearm adjacent to the trigger of the firearm.

19. The method of claim 15, further comprising adjusting a tension of the belt.

* * * * *